United States Patent [19]

Schmidgall

[11] 4,301,638

[45] Nov. 24, 1981

[54] SPACER FOR REINFORCED CONCRETE STRUCTURES

[75] Inventor: Hartzell H. Schmidgall, Mediapolis, Iowa

[73] Assignee: Hawkeye of Iowa, Ltd., Mediapolis, Iowa

[21] Appl. No.: 120,206

[22] Filed: Feb. 11, 1980

[51] Int. Cl.[3] ..... E04C 5/16

[52] U.S. Cl. ..... 52/687; 52/DIG. 1; 52/677

[58] Field of Search ..... 52/687, 688, 689, 677, 52/682, 684, 652, DIG. 1; 24/73 C, 84 C; 248/221.3, 302; 292/246, 256, DIG. 49

[56] References Cited

U.S. PATENT DOCUMENTS

| | | | |
|---|---|---|---|
| 918,716 | 4/1909 | Wedmore | 52/687 |
| 1,561,323 | 11/1925 | Gregg | 52/687 |
| 1,615,651 | 1/1927 | Reynolds | 52/687 |
| 2,299,490 | 10/1942 | Newman | 24/84 C |
| 3,440,792 | 4/1969 | Schmidgall | 52/687 |
| 3,471,986 | 10/1969 | Swenson | 52/652 |
| 3,521,842 | 7/1970 | Opperthauser | 248/302 |
| 3,722,164 | 3/1973 | Schmidgall | 52/684 |
| 4,005,560 | 2/1977 | Simpson | 52/677 |
| 4,152,256 | 5/1979 | Wennberg | 24/73 C |

OTHER PUBLICATIONS

Spacers for Reinforced Concrete Pipe, C.M.C., Blue Ridge Rubber Company, 1976 (price list).

*Primary Examiner*—Price C. Faw, Jr.
*Assistant Examiner*—Henry E. Raduazo
*Attorney, Agent, or Firm*—Henderson & Sturm

[57] ABSTRACT

A spacer element is provided for attachment to a pair of parallel wires of a mesh spaced from a surface of a concrete form or wall and having a projection adapted to maintain the spacing between the wall and the plane of the mesh, the element being of generally hairpin shape and providing a duplicate pair of hooks for hooking over one wire, a duplicate pair of second, S-shaped hooks for hooking over a parallel wire, a duplicate pair of V-shaped projections, and a bight joining the S-shaped hooks and providing a looped lever arm for receiving a tool for forcibly applying the element to the mesh.

2 Claims, 6 Drawing Figures

SPACER FOR REINFORCED CONCRETE STRUCTURES

BRIEF SUMMARY OF THE INVENTION

A conventional concrete structure having interior steel reinforcement may take the form of walls, slabs, cylindrical pipe, etc., but all have in common the use of steel rods, preferably in mesh form, as the reinforcing medium. In the manufacture of, say, cylindrical pipe, the method involves the use of a cylindrical form within which a cylindrical mesh cage is disposed concentrically. Normally, wire or like spacers are attached at intervals to the cage and have radial projections engageable with the form wall or walls for maintaining the spacing between the form and the cage. The best known patented forms of such spacers are those shown in the U.S. Pat. Nos. to Schmidgall 3,440,792 and 3,722,164 and Swenson 3,471,986. Schmidgall '792 shows a spacer intended primarily for use with dual-cage reinforcement and serves not only to space the cages from the form wall but from each other. Schmidgall '164 depicts a spacer having somewhat serpentine hooks for hooking into crossed wires of the same cage and is suited for single-cage reinforcement but is too light for heavy-duty application and braces in only one direction. Swenson's spacer is directed to use in single-cage reinforcement and is made of flat relatively thin steel having opposite hooked ends intended to snap over parallel wires of the cage and to remain in place by the resilient reactions forces between the wires and hooks. Another spacer is known as CMC (last known to have been available from Engineered Wire Products, a Division of Price Bros. Co., P.O. Box 825, Dayton, Ohio 45401) and comprises a rod-like member bent to hairpin shape having hooks at its terminal ends and somewhat less than a hook at its closed or bight end.

All of these prior art spacers suffer from several defects. As said above, the spacer of Schmidgall '792 is intended primarily for dual-cage structures. Schmidgall '164 has been discussed above. The Swenson spacer does not possess the necessary strength for heavy-duty application and cannot withstand side loading. Also, the Swenson spacer, being flat, presents too great an area to the flow of concrete and often results in voids in the finished product. Being thin and flat, it presents sharp edges to the jacket seam during rotation of the cages in the jacket, especially when the packer-head method of forming is used, which method radially compacts the concrete, in a semi-moist no-slump state, by rollers within a jacket and wherein the spacers quite often become partially or totally dislodged, resulting in further defects in the finished product. Being flat, the only way the Swenson spacer can be made stronger is to increase its cross-sectional area, but this still further impedes the free flow of concrete. Also, an increase in size and strength of the Swenson spacer renders it still more difficult to apply the spacer to the cage. The CMC spacer, although of rod-like steel, is of mild steel and is easily distorted. Since its one end at the bight is not a positive hook, it is easily dislodged from the cage. Because it has no resilience, it cannot be applied to cages having mis-spaced and/or heavy gauge wires.

According to the present invention, an improved spacer is provided. Among its desirable features are that it is made of relatively heavy-gauge spring steel and thus is positive in its grip on the cage and can adapt itself to wires of varied tolerance and/or gauge. It has positive hooks at both ends and at one end is provided with an integral lengthwise prolongation serving as a lever for receiving a force-applying tool whereby the spacer may be forcibly applied to the cage in even the most stubborn of cases. The spacer may be easily and economically mass-produced and thus may be provided to the user at relatively low cost. Most heavy-duty spacers must be welded to the mesh, which the present spacer eliminates.

Further features will appear as a preferred embodiment of the spacer is disclosed in detail in the ensuing description and accompanying drawings. The present spacer is also improved in the area of the hump or projection by means of which the cage is spaced from the form wall. The legs or struts of the hump are so designed and related to the hook portions of the spacer so that as radially inward load is applied to the spacer, its grip on the cage increases.

DETAILED DESCRIPTION

Figure 1:
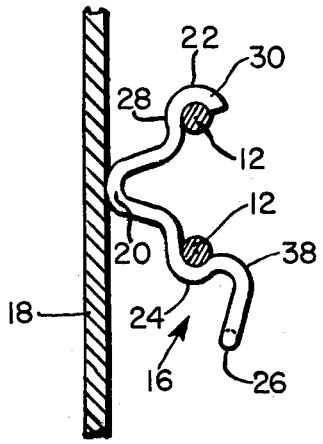
FIG. 1 is a part section, part elevation of the inventive spacer in relation to a form wall and a pair of mesh wires.
Figure 2:
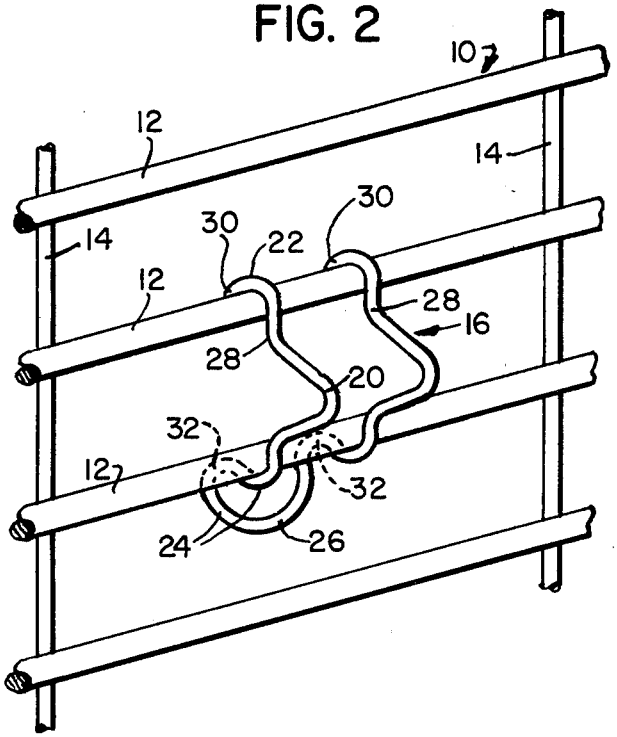
FIG. 2 is a perspective showing the spacer in place on a portion of mesh.
Figure 3:
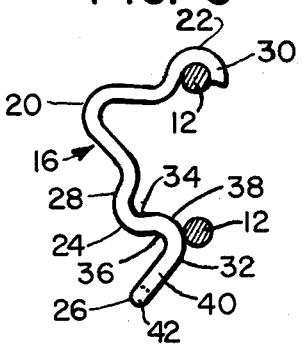
FIG. 3 shows the initial stage of applying the spacer to a pair of mesh wires.

Reference will be had first to FIG. 2, wherein is best shown a representative form of reinforcing mesh 10 made up of a plurality of relatively uniformly spaced horizontal wires 12 and a plurality of cross or vertical wires 14, the wires being typically welded at their intersections to provide a unitary product. A preferred embodiment of the spacer according to the present invention is designated in its entirety by the numeral 16. FIG. 1 shows the relationship of the mesh and spacer to a form wall 18, usually a steel jacket, which in the case of concrete pipe will be cylindrical and will have a longitudinal seam (not shown) where the ends of the jacket meet. This, as indicated, is conventional and details need not be elaborated on. In the illustration here, the form, mesh and spacer are shown as they would be related in the manufacture of concrete pipe by the process of radially compacting semi-dry, semi-moist concrete with roller compaction as in the so-called packer-head method. That is, an interior core is not needed. The present spacer will, of course, function in either system and is not limited in any way to the manufacture of pipe but can be used in the manufacture of other concrete structures.

In any case, it is important that the spacer attach itself firmly to the mesh so as not to become dislodged as a result of forces occurring during the compacting process. It is also important that the spacer maintain a predetermined spacing between the mesh and the form wall, which is accomplished here by hump means 20 included as part of the spacer. The interior of the form wall represents a surface spaced from the mesh and the point of contact between the hump means and this surface represents a point located by the spacer. A typical spacer includes first hook means 22 for hooking over one wire 12 and second hook means 24 for hooking over another wire 12. In the present case, the spacer is shown hooked over neighboring wires but cases are known in which the spacer is long enough to hook over, say, the first and third wires of a group. The present description will continue on the basis of hooking over adjacent wires, but this is not a limitation.

The present spacer is a one-piece rod-like spring steel member formed generally as a hairpin, having a bight 26 and a pair of parallel, elongated, coplanar legs 28. The terminal end portions of the legs provide duplicate hooks 30 which constitute the first hook means 22, and these are so shaped as to obtain a positive hooking action over its wire; that is to say, each hook embraces a substantial portion of the circumference of the wire and thus cannot be accidentally dislodged. The bight end of the spacer is shaped to provide a second pair of duplicate hooks 32, each of S shape. The initial portion of each S-shaped hook that is an extension of the respective leg forms a first hook portion 34 that faces toward the opposite hooks 30 and this portion of each hook is continued in the reverse direction as at 36 to continue the S shape. Where the portions 34 and 36 merge a ramp or cam 38 results, and the portions 36 are continued as prolongations 40 of the length of the spacer and then are cross-connected by the transverse portion 42 of the bight. These prolongations and the portion of the bight establish a lever arm 44 by means of which application of the spacer to the mesh by a tool is facilitated.

Figure 4:
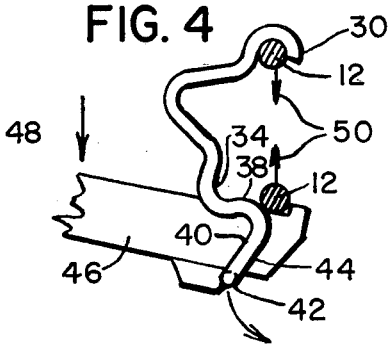
FIG. 4 shows a succeeding stage of application.
Figure 5:
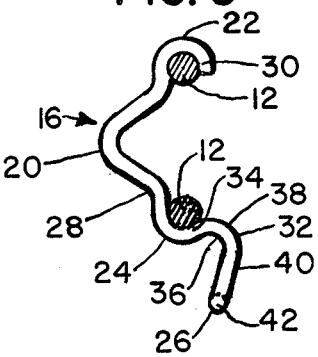
FIG. 5 shows the final installation.

FIG. 4 illustrates the use of a tool, such as a lever 46, received in the lever arm 42 and fulcrumming against the adjacent wire 12 and subject to downward manual pressure (arrow 48) to cam the dual S-shaped hooks over the wire which creates a positive lock of the spacer on to the mesh. As will be further seen from FIG. 4, the spacer is so dimensioned relatively to the wire spacing that, as the spacer is levered into place, the wires are drawn somewhat together (arrows 50) because of their inherent resilience, but the wires and spacer ultimately spring back and coact with the hooks to retain the spacer on the mesh. In some sizes of mesh and spacers, manual application without the tool 46 may be achieved because of the generous length of lever arm 40–42.

Figure 6:
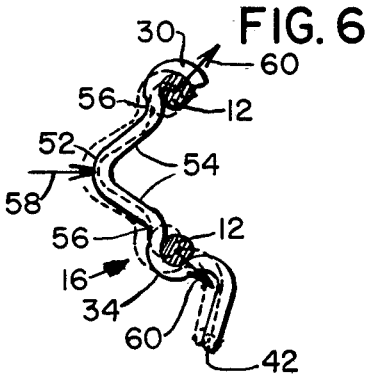
FIG. 6 illustrates the spacer as subjected to loading during the compacting process.

A further feature of the inventive spacer is the construction of the hump means 20, which is in this case of dual nature because of the spacer legs 28. Each hump has an apex 52 which serves as the contact with the form wall 18. From each apex, a pair of struts 54 diverge to blend into the spacer legs at junctions 56, each of which lies inwardly of the spacer portion that engages the wire. As best shown in FIG. 6, this enables the spacer to better embrace the wires as the spacer is deflected under radial inward load (arrow 58). The spacer will deflect (full lines as compared with dotted lines) and the wires will deflect as shown by the arrows 60. These forces all contribute to the further tenacity of the spacer to remain in place on the mesh.

As previously indicated, the form wall or jacket 18 is customarily formed in such manner as to include a longitudinal seam or splice. These never result in smooth connections, and consequently, a slight obstruction will be encountered by the spacers as the cage or mesh and spacers rotate within the form during the manufacturing process. In the present case, the dual humps minimize spacer displacement. As the first hump meets the splice it raises and lifts the trailing hump over the splice. By the time the trailing hump encounters the splice, the leading hump is past the splice and it rides the smooth surface, thus keeping the spacer stable and minimizes spacer displacement. The construction of the spacer from heavy duty spring steel is an important contributor to the strength and tenacity of the spacer and to its ability to stay in place despite substantial forces encountered during the manufacturing process.

The spacer shown is but one of the sizes in which it may be manufactured. That shown here is formed of 3/16" diameter mechanical spring wire, hard drawn. It is adapted for use on mesh having a wire spacing of 2". All inside radii are 3/16". The angle of the lever arm 40, as measured from a line tangent to the curve at 32 and perpendicular to a radius of that curve is on the order of 15°, which means that the lever arm is not only a prolongation of the length of the spacer itself but is also directed back toward the common plane of the legs 28. As best seen in FIG. 4, this improves the lever action of the tool 46. As indicated, these dimensions, etc., are representative and may be varied according to variations in the size, strength, etc., of any selected spacer.

I claim:

1. For use with a concrete reinforcing mesh having parallel wires: a spacer for attachment to the wires and including a projection for locating a point on a surface spaced from the mesh, the spacer being an elongated member positionable with its length crosswise of the wires and having a first hook means at one end for hooking over one wire of the mesh and a second S-shaped hook means at the other end for hooking over a second parallel wire to retain the spacer on the mesh by the resilient reaction force between the S-shaped hook and the second wire, characterized in that the spacer member is of hairpin shape having a bight and a pair of parallel, coplanar legs extending from the bight to respective terminal end portions, said terminal end portions forming duplicate hooks constituting the first hook means and the junction of the legs with the bight forming duplicate S-shaped hooks constituting the second hook means, each S-shaped hook having its portion that merges into the bight extended in prologation of the member and combining with the bight to form a looped lever arm receivable of a force-applying tool between the looped lever arm and the outside face of the mesh, for facilitating the application of force to the bight end of the spacer to cam the S-shaped hooks over the second wire during installation of the member on the mesh, said member being formed of relatively heavy-guage spring steel capable of gripping the wires without permanent distortion of itself.

2. The spacer of claim 1, further characterized in that the projection is constituted by a pair of identical humps extending away from the spacer legs in the direction of the point to be located on the surface, one hump being integral with each leg and having an apex substantially centrally between the first and second hook means and a pair of struts diverging from the apex to junctions with the respective legs, each junction being spaced from the associate hook means toward the center of the spacer by such amount that the junctions are spaced apart more closely than the first and second hooks whereby compressive loads applied to the humps normal to the plane of the mesh tend to increase the grip of the spacer on the wires.

* * * * *